US006823149B2

(12) United States Patent
Yoshikawa et al.

(10) Patent No.: US 6,823,149 B2
(45) Date of Patent: Nov. 23, 2004

(54) IMAGE FORMING APPARATUS WITH VARIABLE SPEED TRANSFERRING AND FIXING DEVICES

(75) Inventors: Takahiro Yoshikawa, Kanagawa (JP); Takayuki Maruta, Kanagawa (JP); Hitoshi Ishibashi, Kanagawa (JP); Yuuji Sawai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/373,050

(22) Filed: Feb. 26, 2003

(65) Prior Publication Data

US 2003/0161649 A1 Aug. 28, 2003

(30) Foreign Application Priority Data

Feb. 28, 2002 (JP) ..... 2002-054245

(51) Int. Cl.[7] ..... G03G 15/20
(52) U.S. Cl. ..... 399/68; 399/400
(58) Field of Search ..... 399/68, 397, 400, 399/396, 16

(56) References Cited

U.S. PATENT DOCUMENTS

| | | | | |
|---|---|---|---|---|
| 4,595,279 A | * | 6/1986 | Kuru et al. | |
| 4,928,141 A | * | 5/1990 | Poehlein et al. | 399/68 |
| 4,931,842 A | * | 6/1990 | Mahoney | 399/400 |
| 5,669,039 A | * | 9/1997 | Ohtsuka et al. | 399/68 |
| 5,850,588 A | | 12/1998 | Yoshikawa | |
| 5,881,334 A | | 3/1999 | Maruta et al. | |
| 6,055,386 A | | 4/2000 | Kato et al. | |
| 6,160,569 A | | 12/2000 | Fujimori et al. | |
| 6,160,974 A | | 12/2000 | Yoshikawa et al. | |
| 6,226,481 B1 | | 5/2001 | Yoneda et al. | |
| 6,301,452 B1 | * | 10/2001 | Yoshizawa | |
| 6,360,065 B1 | | 3/2002 | Ishibashi et al. | |
| 6,405,002 B2 | | 6/2002 | Ogiyama et al. | |
| 6,470,161 B2 | | 10/2002 | Fujishiro et al. | |
| 6,501,914 B2 | | 12/2002 | Yoshikawa | |

(List continued on next page.)

FOREIGN PATENT DOCUMENTS

| | | | | |
|---|---|---|---|---|
| JP | 61059368 A | * | 3/1986 | G03G/15/00 |
| JP | 07-140845 | | 6/1995 | |
| JP | 10039558 A | * | 2/1998 | G03G/15/00 |
| JP | 2915510 | | 4/1999 | |
| JP | 11119573 A | * | 4/1999 | G03G/15/20 |
| JP | 2001312193 A | * | 11/2001 | G03G/21/14 |
| JP | 2001-354337 | | 12/2001 | |

OTHER PUBLICATIONS

U.S. patent application Ser. No. 10/740,672, Kamiya, filed Dec. 22, 2003.

(List continued on next page.)

*Primary Examiner*—Susan Lee
(74) *Attorney, Agent, or Firm*—Oblon, Spivak, McClelland, Maier & Neustadt, P.C.

(57) ABSTRACT

An image forming apparatus of the present invention includes an intermediate image transfer belt to which a toner image is to be transferred from an image carrier, an image transferring device for transferring the toner image from the intermediate image transfer belt to a sheet, and a fixing device for fixing the toner image on the sheet. When the length of the sheet in the direction of conveyance is smaller than a distance between the image transferring device and the fixing device, a matching circuit varies only the speeds of the image transferring device and fixing device, but does not vary the speed of a device that executes a step preceding the image transfer step. The matching device then sets an interval between consecutive sheets matching with the varied speeds of the image transferring device and fixing device, thereby matching opposite sides with respect to the image transfer step to each other as to the number of sheets to be conveyed.

5 Claims, 6 Drawing Sheets

U.S. PATENT DOCUMENTS

| | | | |
|---|---|---|---|
| 6,505,022 | B2 | 1/2003 | Kosuge et al. |
| 6,516,179 | B1 | 2/2003 | Sawai et al. |
| 6,519,428 | B1 | 2/2003 | Ohtoshi et al. |
| 6,535,707 | B2 | 3/2003 | Maruta et al. |
| 6,546,219 | B2 | 4/2003 | Sato et al. |

OTHER PUBLICATIONS

U.S. patent application Ser. No. 10/798,382, Ishibashi, filed Mar. 12, 2004.

U.S. patent application Ser. No. 10/746,060, Enoki et al., filed Dec. 29, 2003.

U.S. patent application Ser. No. 10/722,490, Ishibashi et al., filed Nov. 28, 2003.

U.S. patent application Ser. No. 10/700,486, Yoshida et al., filed Nov. 5, 2003.

U.S. patent application Ser. No. 09/758,192, Sato et al., filed Jan. 12, 2001.

U.S. patent application Ser. No. 09/764,261, Yoshikawa, filed Jan. 19, 2001.

U.S. patent application Ser. No. 09/947,391, Kawagoe et al., filed Sep. 7, 2001.

U.S. patent application Ser. No. 09/960,922, Aoki et al., filed Sep. 25, 2001.

U.S. patent application Ser. No. 10/114,265, Maruta et al., filed Apr. 3, 2002.

U.S. patent application Ser. No. 10/178,685, Sugino et al., filed Jun. 25, 2002.

U.S. patent application Ser. No. 10/193,219, Takahashi et al., filed Jul. 12, 2002.

U.S. patent application Ser. No. 10/193,240, Sawai, filed Jul. 12, 2002.

U.S. patent application Ser. No. 10/200,178, Tamiya et al., filed Jul. 23, 2002.

U.S. patent application Ser. No. 10/214,595, Sakamoto, filed Aug. 9, 2002.

* cited by examiner

FIG. 7

| | STANDARD SPEED:A | A/1.5 | A/2 | A/2.5 |
|---|---|---|---|---|
| TRANSMISSION COLORING | × | × | ○ | ○ |
| HOT OFFSET | ○ | ○ | ○ | ○ |
| | A/3 | A/3.5 | A/4 | A/4.5 |
| TRANSMISSION COLORING | ○ | ○ | ○ | ○ |
| HOT OFFSET | ○ | ○ | ○ | × |

IMAGE FORMING APPARATUS WITH VARIABLE SPEED TRANSFERRING AND FIXING DEVICES

BACKGROUND OF THE INVENTION

1. Field of the Invention

The present invention relates to a facsimile apparatus, printer or similar image forming apparatus and more particularly to an image forming apparatus capable of controlling the conveyance of a paper sheet or similar recording medium.

2. Description of the Background Art

It is a common practice with an image forming apparatus to form a toner image on a photoconductive drum or similar image carrier and then electrostatically transfer the toner image to a paper sheet, OHP (OverHead Projector) film or similar recording medium (sheet hereinafter). The toner image transferred to a sheet is simply retained on the sheet by an electrostatic force and must therefore be semipermanently fixed thereon by heat and/or pressure.

Among various fixing systems known in the art, a fixing system of the type using a heat roller is predominant over the others because it has high thermal efficiency and safe. More specifically, in this type of system, two rollers, one of which is implemented as a heat roller, are pressed against each other and convey a sheet carrying a toner image thereon via a nip between the rollers. As a result, the toner image is fixed on the sheet by heat and pressure.

The toner image may be a monochromatic image or a color image formed by toners of different colors superposed on each other. A color image generally refers to a two-color or a three-color image. A fixing condition, i.e., the amount of heat necessary for fixation differs from a monochromatic image to such a color image. A full-color image, for example, sometimes needs a great amount of heat because a glass transition point matching with required gloss and coloring property must be established. In addition, a great amount of head is sometimes required in relation to the material and thickness of the sheet as well. In light of this, when the amount of heat of a fixing device and the increase of the same are fixed, it has been customary to vary sheet conveying speed for thereby increasing the duration of sheet heating.

To increase the amount of heat to act on a sheet carrying a full-color image thereon, the conveying speed of an image transferring device and that of a fixing device may be varied after the transfer of the image to the sheet, as taught in, e.g., Japanese Patent Laid-Open Publication Nos. 5-265299, 5-100515, 6-348146 and 8-22203. In accordance with these documents, the conveying speeds of image transferring device and fixing device are switched in matching relation to the number of toners and material, e.g., an OHP film poor in coloring property or wax-containing toner poor in gloss, so that a necessary amount of heat can be implemented. This scheme, however, has the following problems left unsolved.

A tandem, color image forming apparatus, for example, includes a plurality of photoconductive drums and a plurality of developing devices adjoining the drums. While these members each are driven by a respective motor, such motors are not controlled independently of each other, but are controlled in accordance with the overall image forming sequence. Consequently, when the speeds of the image transferring device and fixing device are varied, they influence the other drive sources. It is therefore necessary to use special arrangements for coping with a plurality of motor outputs, as distinguished from a single standard speed. Particularly, when a recording medium of the kind needing a great amount of heat for fixation is used, it must be conveyed at low speed. This cannot be done without resorting to a motor capable of outputting high torque inversely proportional to the low speed, as will be apparent from a relation between the rotation speed and the torque. Such an arrangement therefore increases the cost of the apparatus. Moreover, despite that only the image transferring device and fixing device are the subject of speed control, even a sheet feeding device must be variable in speed. However, the speed of the sheet feeding device cannot be varied until the pay-out of a sheet ends, resulting in a time loss.

Technologies relating to the present invention are also disclosed in, e.g., Japanese Patent Laid-Open Publication Nos. 7-140845 and 2001-354337 as well as in Japanese Patent No. 2,915,510.

SUMMARY OF THE INVENTION

It is an object of the present invention to provide an image forming apparatus capable of rapidly varying the conveying speed of a recording medium without increasing cost or space.

An image forming apparatus of the present invention includes an intermediate image transfer belt to which a toner image is to be transferred from an image carrier, an image transferring device for transferring the toner image from the intermediate image transfer belt to a sheet, and a fixing device for fixing the toner image on the sheet. When the length of the sheet in the direction of conveyance is smaller than a distance between the image transferring device and the fixing device, a matching circuit varies only the speeds of the image transferring device and fixing device, but does not vary the speed of a device that executes a step preceding the image transfer step. The matching device then sets an interval between consecutive sheets matching with the varied speeds of the image transferring device and fixing device, thereby matching opposite sides with respect to the image transfer step to each other as to the number of sheets to be conveyed.

BRIEF DESCRIPTION OF THE DRAWINGS

The above and other objects, features and advantages of the present invention will become more apparent from the following detailed description taken with the accompanying drawings in which:

FIG. 7 is a table listing the results of experiments relating to another alternative embodiment of the present invention.

DESCRIPTION OF THE PREFERRED EMBODIMENTS

Figure 1:
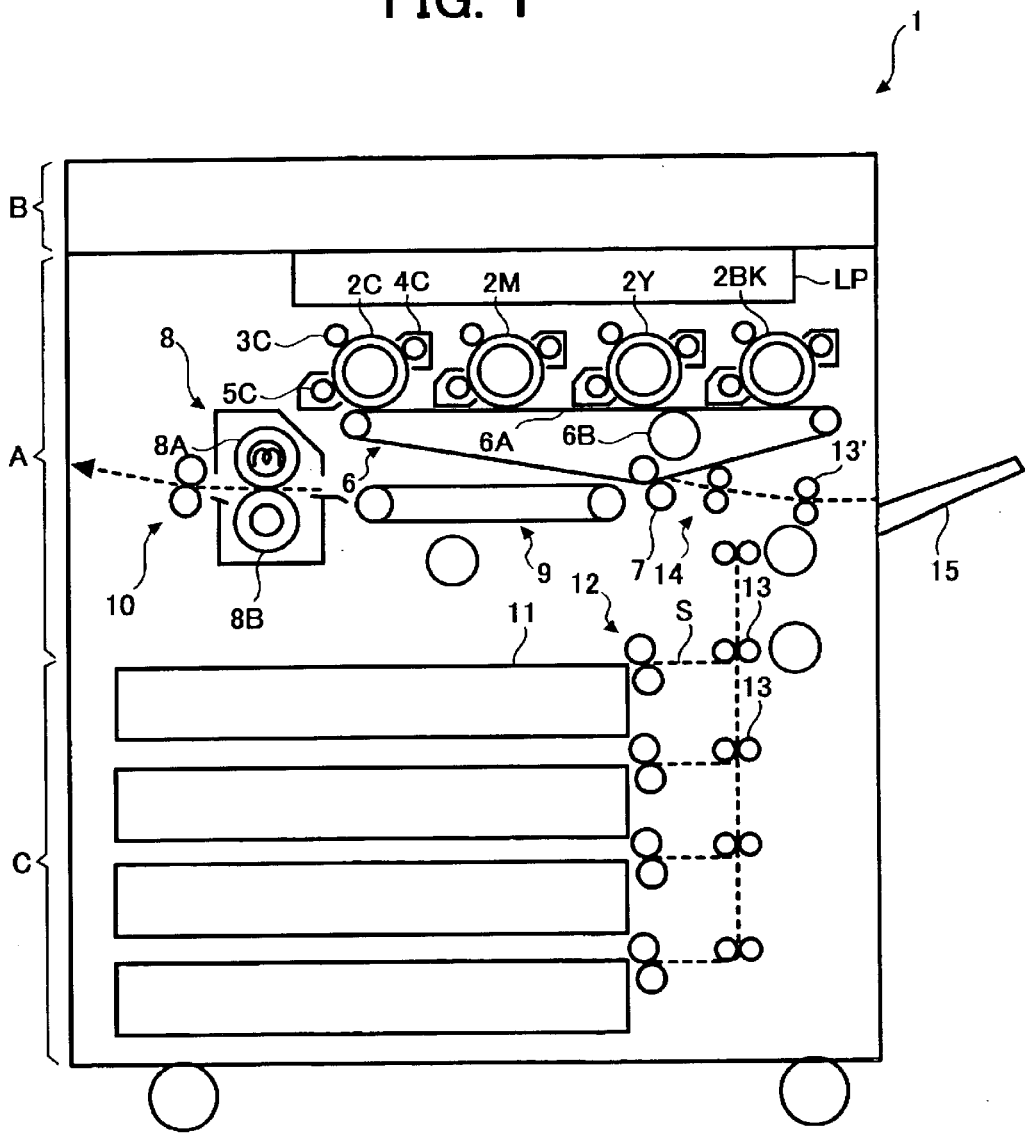
FIG. 1 is a view showing the general construction of an image forming apparatus embodying the present invention.

Referring to FIG. 1 of the drawings, an image forming apparatus embodying the present invention is shown and implemented as a tandem full-color printer by way of example. As shown, the full-color printer, generally 1, is generally made up of an image forming section A, a document scanning section B positioned above the image forming section A, and a sheet feeding section C positioned below the image forming section A.

The image forming section A includes photoconductive drums or image carriers 2C, 2M, 2Y and 2BK arranged side by side. Latent images can be formed on the drums 2C, 2M, 2Y and 2BK in accordance with cyan (C), magenta (M), Yellow (Y) and black (BK) image data, respectively. The drums 2C through 2BK each are included in a respective image unit. In the image unit including, e.g., the drum 2C, a charger 3C, an optical writing device LP, a developing device 4C and a cleaning device 5C are arranged around the drum 2C. The drums 2C through 2BK are positioned to face an intermediate image transferring device 6, which serves as a primary image transferring device.

More specifically, the intermediate image transferring device 6 includes an image transfer belt (simply belt hereinafter) 6A to which toner images of different colors formed on the drums 2C through 2BK are sequentially transferred one above the other. The drums 2C through 2BK face the upper run of the belt 6A. The belt 6A is passed over a plurality of rollers and movable into contact with the drums 2C through 2BK. A bias roller 6B is held in contact with the inner surface of the upper run of the belt 6A and applies a bias for image transfer, so that the toner images are sequentially transferred from the drums 2C through 2BK to the belt 6A one above the other, completing a full-color toner image.

A secondary image transferring device 7 faces one of the rollers over which the belt 6A is passed. In the illustrative embodiment, the secondary image transferring device 7 is implemented as an image transfer roller. While the image transfer roller 7 nips and conveys a sheet or recording medium S fed from the sheet feeding section C in cooperation with the belt 6A, the roller 7 transfers the full-color toner image to the sheet S at a time.

A conveyor 9 includes a belt passed over a pair of rollers, as illustrated. The conveyor 9 conveys the sheet S carrying the full-color toner image to a fixing device 8. In the illustrative embodiment, the fixing device 8 includes a heat roller 8A accommodating a heater therein and a press roller 8B pressed against the heat roller. The heat roller 8A and press roller 8B fixe the toner image on the sheet S with heat and pressure while conveying the sheet S in cooperation. The sheet S coming out of the fixing device 8 is driven out of the printer to, e.g., a print tray, not shown, by an outlet roller pair 10.

In the illustrative embodiment, the distance between the secondary image transferring device 7 and the fixing device 8 is selected to be only slightly greater than the entire length of the sheet S of A4 landscape size or LT landscape size, as will be described in detail later. This distance is used as a reference for controlling conveying speed in accordance with the sheet length. In addition, such a distance reduces the length of the conveyor 9 for thereby saving space.

The sheet feeding section C includes a plurality of sheet cassettes 11. Sheet feeding members 12, including a pickup roller and a separator roller, are positioned at the outlet of each cassette 11. In FIG. 1, the sheet feeding members 12 are represented by a pair of separator rollers configured to pay out only the top sheet by separating sheets underlying it. A plurality of roller pairs 13 are arranged on conveyance paths extending from the sheet cassettes 11.

The sheet feeding section C further includes a registration roller pair 14 positioned upstream of the secondary image transferring device 7 in the direction of sheet conveyance. A manual feed tray 15 is foldably mounted on one side of the printer 1. A conveyance path also extends from the manual feed tray 16 to the registration roller pair 14 and includes a roller pair 13'.

Figure 2:
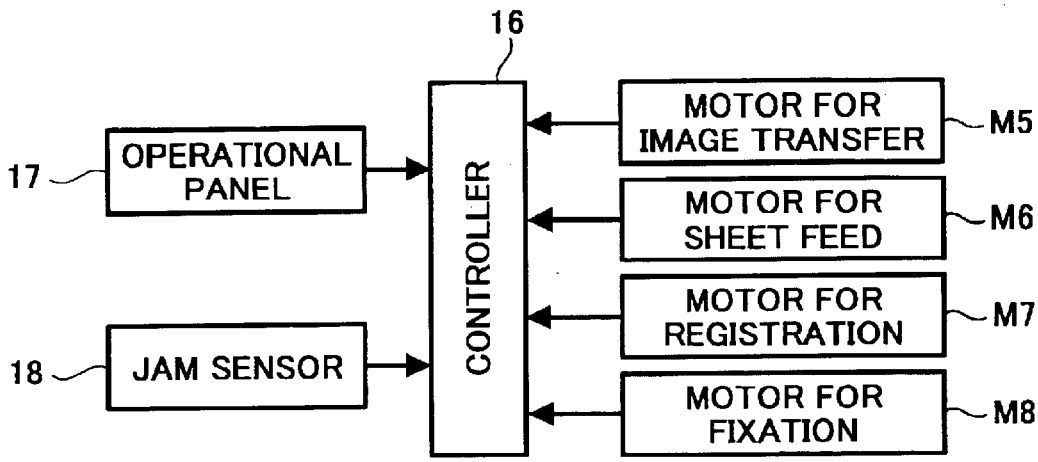
FIG. 2 is a schematic block diagram showing a control system included in the illustrative embodiment.

A drive mechanism included in the illustrative embodiment will be described hereinafter. Motors or drive sources M1, M2, M3 and M4, not shown, respectively drive the drums 2C, 2M, 2Y and 2BK that differ from each other as to drive condition and timing, which is variable to avoid, e.g., jitter. As shown in FIG. 2, a motor or drive source M5 is assigned to the intermediate image transferring device 6 while a motor or drive source M6 is assigned to the sheet feeding members 12 and roller pairs 13 and 13'. A motor or drive source M7 is assigned to the registration roller pair 14. Further, a motor or drive source M8 is assigned to the conveyor 9 and fixing device 8 arranged downstream of the secondary image transfer station in the direction of sheet conveyance.

FIG. 2 shows a control system or speed control means for controlling conveyance speed. As shown, the control system includes a controller 16 whose input side is connected to an operation panel and a Dam sensor 18. The jam sensor 18 is responsive to the condition in which the sheet S is being conveyed. The output side of the controller 16 is connected to the motors M5 through M8.

Figure 3:
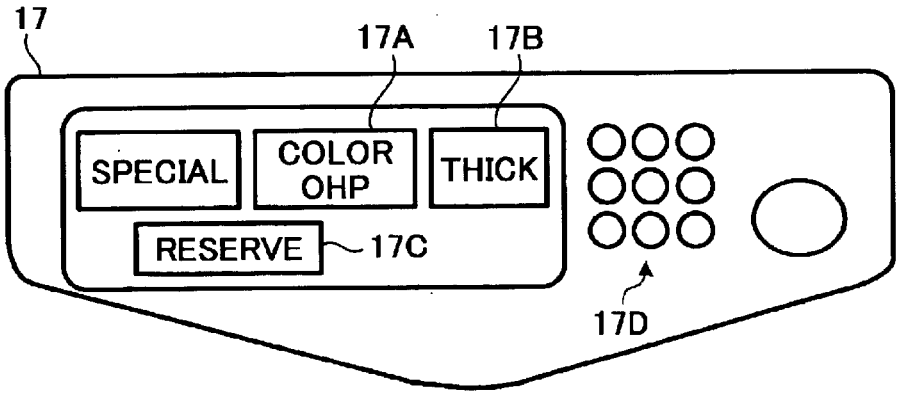
FIG. 3 is a view showing a specific configuration of an operation panel included in the control system of FIG. 2.

FIG. 3 shows a specific configuration of the operation panel 17. As shown, the operation panel 17 includes switches 17A and 17B for allowing the operator of the printer to input the kind of sheets S to use, e.g., OHP films or the thickness of sheets S to use. Also arranged on the operation panel 17 are a reserve mode switch 17 and numeral keys 17D.

Figure 4:
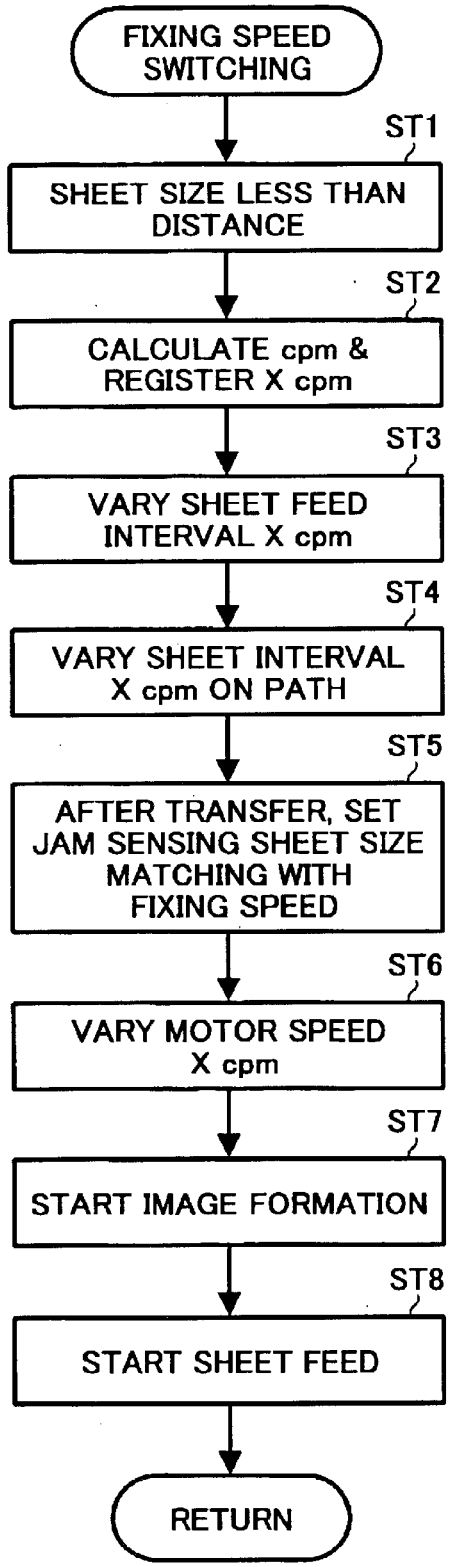
FIG. 4 is a flowchart demonstrating a specific operation of the illustrative embodiment.

FIG. 4 demonstrates a specific operation of the illustrative embodiment, more specifically the controller 16. In FIG. 4, the recording medium is represented by a sheet. As shown, when a fixing speed switch command is input, the controller 16 determines a sheet size. If the sheet size determined is smaller than the distance between the secondary image transferring device 7 and the fixing device 8 (step ST1), then the controller 16 calculates a cpm (copies per minute) value available with the motor M4 assigned to the fixing unit 8 (step ST2) while registering the thus calculated cpm as a value Xcpm. Subsequently, the controller 16 varies the timing for paying out a sheet from the sheet feeding section C in accordance with the registered value Xcpm, thereby varying the interval between consecutive sheets (step ST3)

Figure 5:
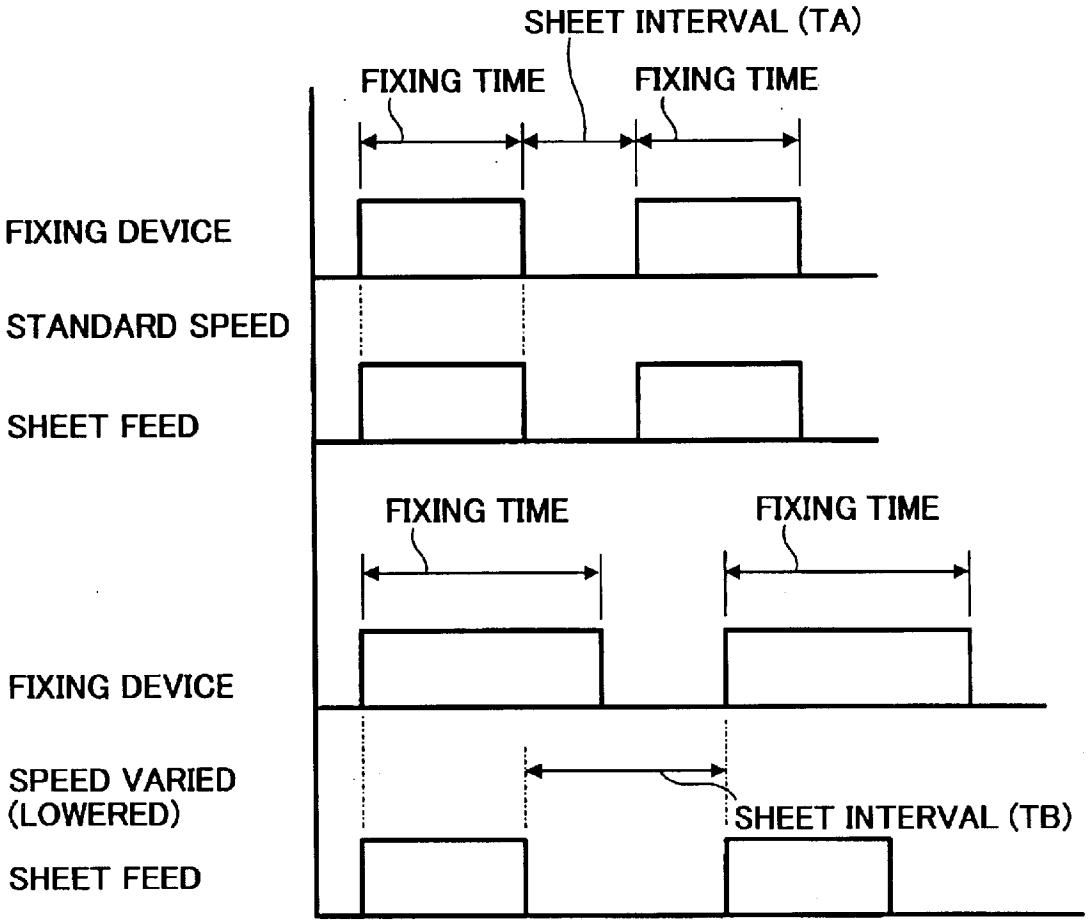
FIG. 5 is a timing chart showing a specific condition wherein the interval between consecutive sheets is varied during the operation of FIG. 4.

FIG. 5 is a timing chart showing a specific case wherein the interval between consecutive sheets is varied. More specifically, in FIG. 5, the speed of the motor M8 is lowered from a standard speed by way of example. As shown, as for the standard speed, the distance (TA) between consecutive sheets is the same in both of the sheet feeding section C and fixing device 8. By contrast, when the speed of the motor M8 is lowered from the standard speed, the timing for paying out a sheet from the sheet feeding section is delayed in matching relation to the resulting increase in the fixing time of the fixing device 8, thereby increasing the interval (TB) between consecutive sheets. In this manner, even when the fixing time is increased, the number of sheets to be conveyed to the fixing device 8 can be matched to the fixing time.

Referring again to FIG. 4, the controller 16 thus varied the interval between sheets at the sheet feeding section C further varies the same interval at a device included in the image forming section and configured to execute a step preceding the image transfer step (step ST4). At the same time, the controller 16 varies the sensing timing of the jam sensing in accordance with the above interval (step ST5). The interval variation in the step ST4 may be effected by, e.g., the drive timing of the registration roller pair 14.

After the step ST5, the controller 16 varies the speed of the motor M8 assigned to the fixing device 8 (step S6), energizes the charger for image formation (step ST7), and causes the sheet feeding section C to start paying out a sheet (step ST8).

As stated above, the drive source assigned to the device configured to execute the step that precedes image transfer step should only have its operation timing varied without having its speed varied. It follows that image formation can be executed in accordance with the varied speeds of the secondary image transferring device 7 and fixing device 8 despite that the motor output does not have to be varied.

An alternative embodiment of the present invention will be described hereinafter. The alternative embodiment is characterized in that the speed is varied in a preselected ratio for thereby reducing a period of time necessary for calculation.

In the illustrative embodiment, the speed of the fixing device 8 must be varied when the sheet S is of A4 landscape size or LT landscape size. In light of this, the distance between the secondary image transferring device 7 and the fixing device 8 is selected to be only slightly greater than the size of the sheet S. This distance is used as a reference in setting the conveying speed of the fixing device 8 in accordance with the size of a sheet to be conveyed. The conveying speed of the fixing device 8 is varied in a preselected ratio. Therefore, the operation timing of the device configured to execute the step preceding the image transfer step can also be set in a preselected ratio.

Figure 6:
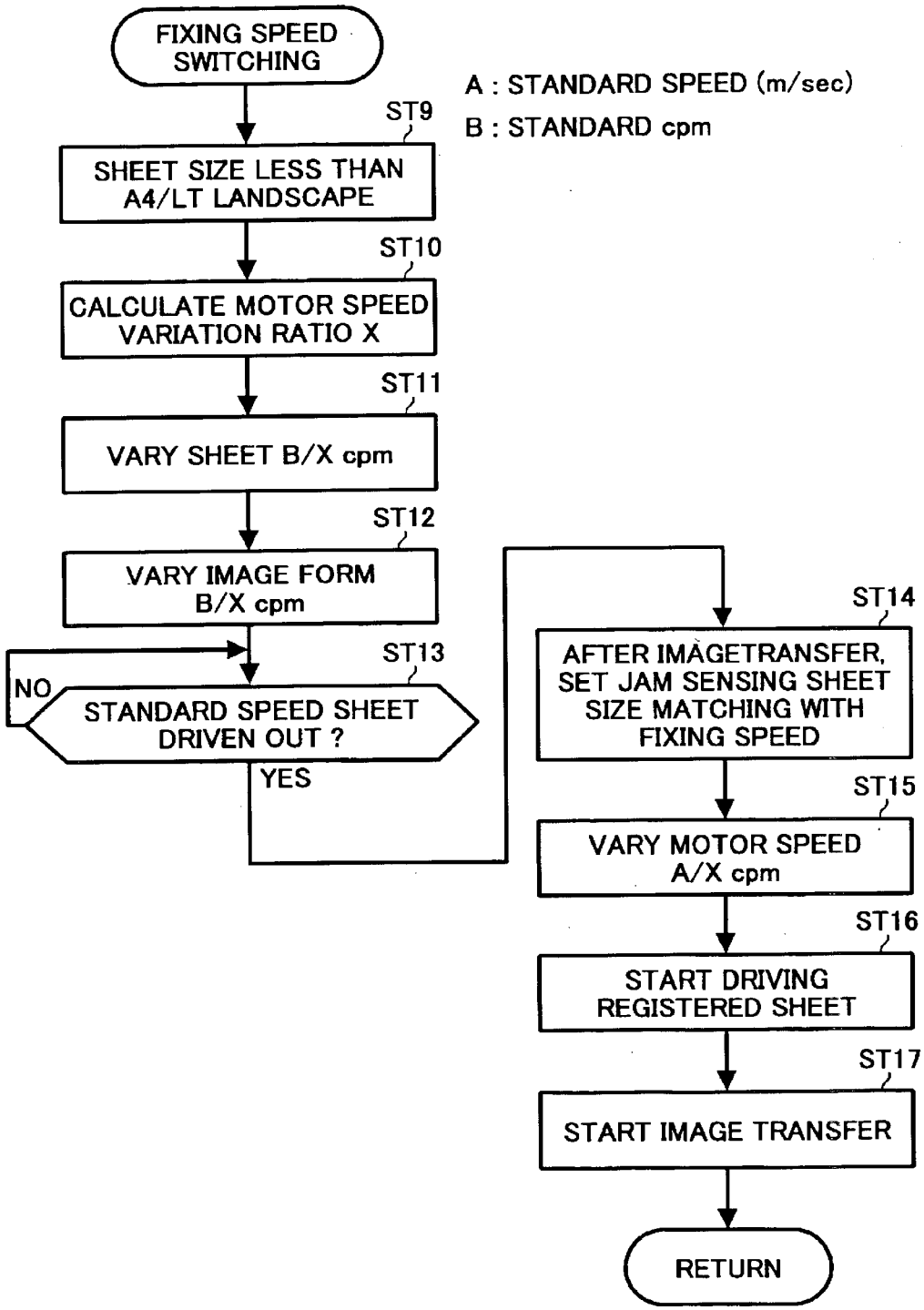
FIG. 6 is a flowchart representative of an alternative embodiment of the present invention.

FIG. 6 demonstrates a specific operation of the illustrative embodiment. As shown, when the fixing speed should be varied, the controller 16, FIG. 2, determines the size of sheets to be used. If the sheet size determined is smaller than the distance between the image transferring device 7 and the fixing device 8 (A4 landscape or LT landscape) (step ST9), then the controller 16 calculates a ratio X in which the speed of the motor M8 should be varied and registers it (step ST10). Subsequently, the controller 16 replaces the standard cpm value available with the sheet feeding section with a new value Xcpm to thereby vary the sheet feed timing (step ST11). As a result, the interval between consecutive sheets is varied.

After the step S11, the controller 16 switches the operation timing of the device, which executes the step preceding the image transfer step, from one corresponding to the standard cpm to one matching with the newly registered value Xcpm (step S12) When a sheet being fixed by the fixing device 8 at the standard speed is fully driven out (YES, step ST13), the controller 16 switches the jam sensing timing on the path following the image transfer station to one matching with the speed variation of the fixing device 8 (step S14).

Subsequently, the controller 16 varies the speed of the motor M8 assigned to the fixing device 8 and causes the sheet feeding section C to pay out a sheet at a new timing (registration timing) matching with the conveying speed of the fixing device 8 (step ST16). The controller 16 then causes image transfer to begin (step ST17).

As stated above, the illustrative embodiment varies the speed of the fixing device 8 by a preselected ratio and simply varies the operation timing of the device, which executes the step preceding the image transfer step, in accordance with the above ratio. This makes it needless to vary the speed of the above particular device and obviates complicated calculations, thereby implementing the variation in a short period of time. Moreover, the speed of the fixing device 8 is varied after the size of sheets to be used has been sensed, and can therefore be varied immediately after a sheet present in the fixing device 8 has been driven out.

Another alternative embodiment of the present invention will be described hereinafter. As for the ratio stated above, this embodiment lowers the speed from the standard speed by using coloring as a condition when use is made of wax-containing toner. More specifically, wax-containing toner causes wax to appear on the surface only when the toner is melted by heat. It follows that this kind of wax is poor in coloring property and therefore in the transmission coloring of an OHP film. While this problem may be solved if the amount of heat for fixing the toner is increased, such a scheme is apt to bring about so-called hot offset. We conducted a series of experiments to determine the ratio of speed variation that could enhance the transmission coloring of an OHP film without bringing about hot offset. FIG. 7 shows the results of experiments. As shown, when use is made of wax-containing toner and an OHP film, the speed reduction ratio should preferably be between 1/2 and 1/4.

In summary, it will be seen that the present invention provides an image forming apparatus having various unprecedented advantages, as enumerated below.

(1) The numbers of sheets to be conveyed at opposite sides with respect to an image transfer step can be matched only if the speed of an image transferring device and that of a fixing device are varied to set up a corresponding interval between sheets. This makes it needless to vary the speed of the entire image forming sequence. It follows that a drive source assigned to a device, which executes a step preceding the image transfer step, does not have to be variable in speed, i.e., should only be operable at a standard speed. This prevents the cost of the apparatus from increasing.

(2) The interval between consecutive sheets should only be determined by the timing at which a sheet feeding device feeds a sheet without resorting to any special control. This also prevents the cost of the apparatus from increasing.

(3) The speed can be varied in a preselected ratio in accordance with the size or the kind of a sheet. This allows a preselected ratio to be assigned even to the device that effects the step preceding the image transfer step, thereby obviating complicated calculations and promoting rapid speed variation.

(4) When the operator of the apparatus selects, e.g., a reserve mode, selecting means for speed switching allows a speed variation command to be input before the start of reserve mode operation. The operator therefore does not have to stand by the apparatus until the start of the reserve mode operation. The apparatus is therefore convenient to use.

Various modifications will become possible for those skilled in the art after receiving the teachings of the present disclosure without departing from the scope thereof.

What is claimed is:

1. An image forming apparatus comprising:

an intermediate image transfer belt to which a toner image is to be transferred from an image carrier;

an image transferring device configured to transfer the toner image from said intermediate image transfer belt to one of a plurality of recording media;

a fixing device configured to fix the toner image transferred to the one of a plurality of recording media; and matching means for varying, when a length of the one of a plurality of recording media in a direction of conveyance is smaller than a distance between said image transferring device and said fixing device, a speed of said image transferring device and a speed of said fixing device while maintaining an intermediate image transfer belt speed constant, and setting an interval between consecutive recording media, said interval corresponding to said varied speed of said image transferring device and said varied speed of said fixing device, thereby matching opposite sides with respect to said image transfer step to each other as to a number of recording media to be conveyed.

2. The apparatus as claimed in claim 1, further comprising:

a feeding device; and a jam sensing member on a medium conveyance path, wherein said matching means is configured to set the interval between consecutive recording media in accordance with a timing at which the feeding device feeds the plurality of recording media, and to vary a sensing timing of said jam sensing member in accordance with said timing at which the feeding device feeds the plurality of recording media.

3. The apparatus as claimed in claim 1, wherein when the recording media to be conveyed to a path between said image transferring device and said fixing device has an A4 landscape size or an LT landscape size, said varied speed of said image transferring device and said varied speed of said fixing device each corresponds to an original speed of said image transferring device and an original speed of said fixing device.

4. The apparatus as claimed in claim 1, wherein when the recording media is an OHP (OverHead Projector) film, said varied speed of said image transferring device and said varied speed of said fixing device each corresponds to an original speed of said image transferring device and an original speed of said fixing device by a preselected ratio ranging from 1/4 to 1/2.

5. The apparatus as claimed in claim 1, wherein said plurality of recording media comprises an OHP film carrying a transmission coloring image or a relatively thick recording medium, and said matching means comprises means for switching the speed of said plurality of recording media.

* * * * *